US005611495A

United States Patent [19]

Williams

[11] Patent Number: 5,611,495

[45] Date of Patent: Mar. 18, 1997

[54] ROTARY SHREDDING APPARATUS WITH ANTI-JAM MEANS

[76] Inventor: Robert M. Williams, 16 La Hacienda, Ladue, Mo. 63124

[21] Appl. No.: 554,269

[22] Filed: Nov. 6, 1995

[51] Int. Cl.[6] ..... B02C 4/08

[52] U.S. Cl. ..... 241/73; 241/87; 241/89.1; 241/236

[58] Field of Search ..... 241/73, 87, 88.4, 241/89.1, 236, 224

[56] References Cited

U.S. PATENT DOCUMENTS

| | | | |
|---|---|---|---|
| 3,664,592 | 5/1972 | Schweigert et al. | 241/236 UX |
| 4,046,324 | 9/1977 | Chambers | 241/46.06 |
| 4,385,732 | 5/1983 | Williams | 241/167 |
| 5,154,363 | 10/1992 | Eddy | 241/30 |
| 5,199,666 | 4/1993 | Williams | 241/73 |

FOREIGN PATENT DOCUMENTS

| | | | |
|---|---|---|---|
| 558654 | 6/1958 | Canada | 241/73 |
| 194624 | 1/1907 | Germany | 241/87 |
| 952759 | 10/1956 | Germany | 241/87 |
| 992086 | 1/1983 | U.S.S.R. | 241/73 |

*Primary Examiner*—John M. Husar
*Attorney, Agent, or Firm*—Polster, Lieder, Woodruff & Lucchesi, L.C.

[57] ABSTRACT

A shredding apparatus for converting waste material, like vehicle tires, into a shredded size by driving a pair of shafts having cooperating shredding discs on the shafts, mounting the pair of shredding shafts in an open top cage to receive waste material for reduction and discharge through material sizing grate below the material shredding shafts, oscillating the cage relative to the pair of shafts with the result that some waste material works its way into dead spaces between the movable cage walls and the shredding shafts, and employing waste material devices in the dead spaces to process the waste material in the dead spaces so as to alleviate increase in the driving load.

8 Claims, 4 Drawing Sheets

ROTARY SHREDDING APPARATUS WITH ANTI-JAM MEANS

BACKGROUND OF THE INVENTION

The invention is related to rotary shredding apparatus for the transformation of discarded vehicle tires into a shredded form suitable for conversion to other products making use of the materials usually in vehicle tires.

Apparatus for shredding waste materials is well known as the need to protect the environment from being contaminated by waste that is slow to decompose in land fills. A variety of waste materials contains compositions that can be convened into other products that continue a useful life. One such known shredding apparatus is seen in U.S. Pat. No. 5,199,666 of Apr. 6, 1993.

Other examples of shredding apparatus include solid waste comminutors in U.S. Pat. Nos. 4,046,324 of Sep. 6, 1977, or 4,385,732 of May 31, 1983 for breaking and shredding waste material. In these examples there are powered parallel shafts with cutters on each shaft which overlap to perform the material shredding function.

Earlier examples include U.S. Pat. No. 3,664,592 of May 23, 1972, a Canadian Patent 558,654 of Jun. 10, 1958, and a USSR Patent 0992086 of January 1983.

The problem with apparatus making up the prior an is that there is no consistent effort made to obtain a useful reduction of the material to a size that is easily applied to processes for convening the shredded material into other products on an economical scale. Furthermore, the apparatus lacks provisions for handling materials known to hang together and cause jamming in the apparatus.

SUMMARY OF THE INVENTION

A primary object of the invention is to be able to accept vehicle tires of all sizes and shred the same so as to prevent jamming the tires in the rotary shafts which interferes with the desired thru-put of the shredded material.

It is an object to manipulate the vehicle tires into positions that prevent unshredded tires getting jammed in the approach to the cutters of the apparatus.

A further object is to have the shredded material fall on a system of grates that are in continuous motion so that the shredded material is being sized as it leaves the shredding apparatus.

These and other objects of the invention are practiced in the shredding apparatus which discloses a preferred embodiment that produces practical results.

BRIEF DESCRIPTION OF THE EMBODIMENT

DETAILED DESCRIPTION OF THE EMBODIMENT

Figure 1:
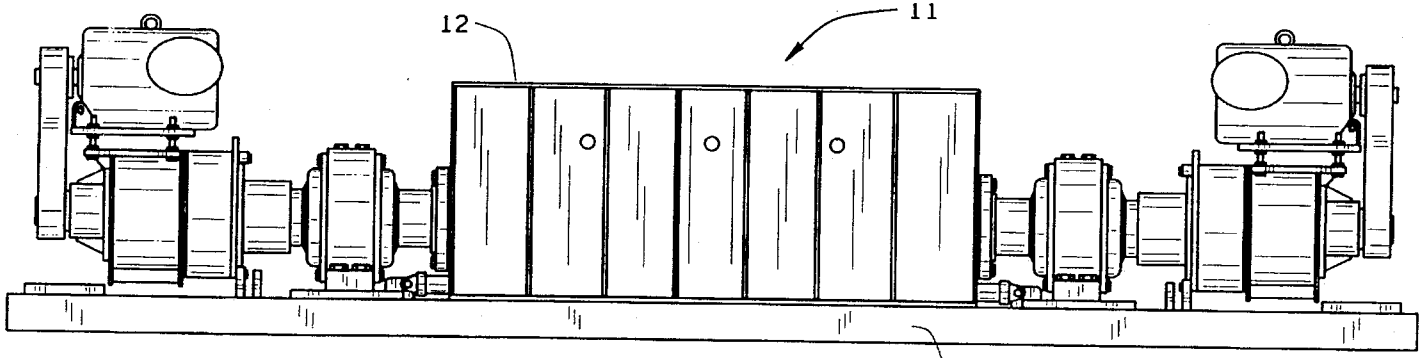
FIG. 1 is a longitudinal side elevational view of the shredder apparatus.
Figure 2:
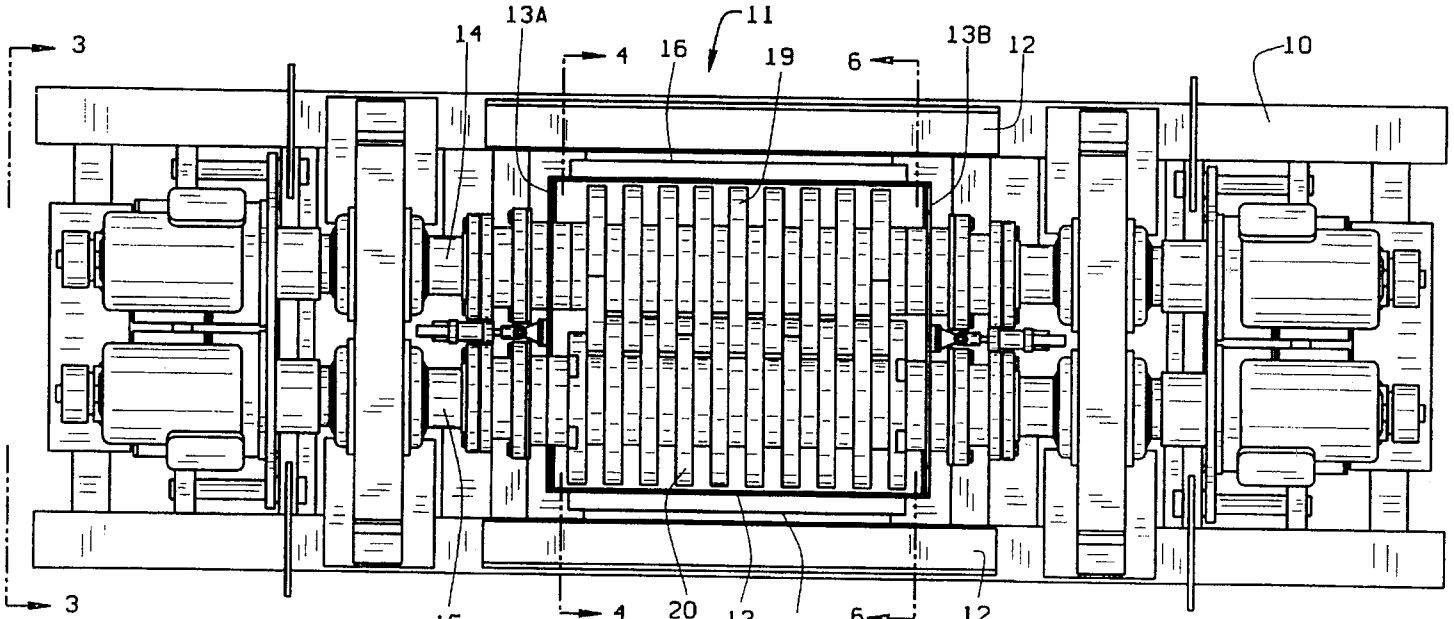
FIG. 2 is a longitudinal top plan view of the apparatus seen in FIG. 1.
Figure 3:
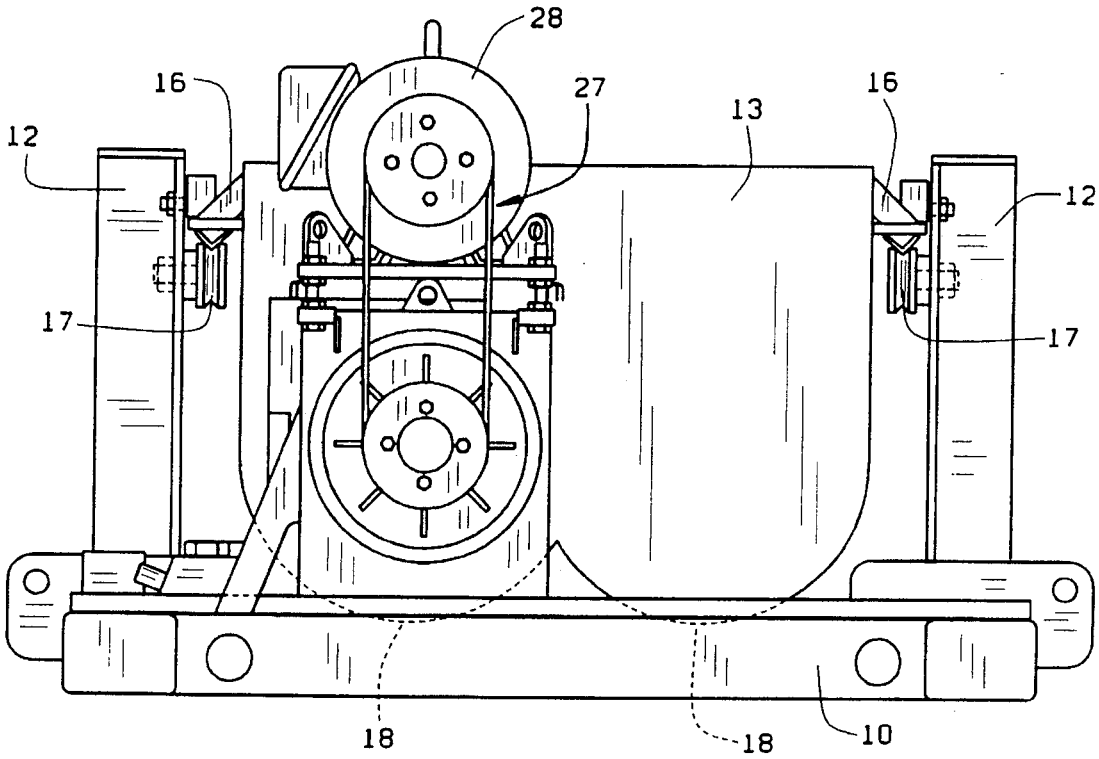
FIG. 3 is an end elevation view as seen along 3—3 in FIG. 1 showing a track and roller mounting for the shredder cage.
Figure 4:
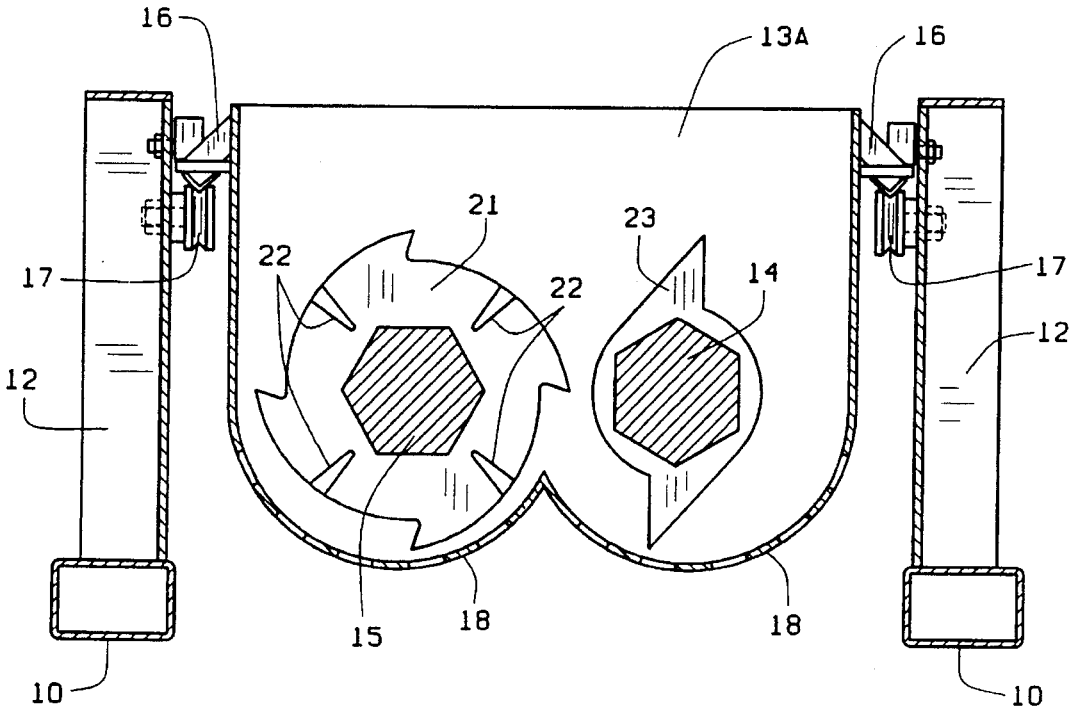
FIG. 4 is an end sectional view transverse to the axis of the shafts, the view being taken along the line 4—4 in FIG. 1.

Referring to FIGS. 1 and 2 there is shown a base 10 on which is mounted the waste material ripshear rotary assembly 11 which comprises a frame 12 which extends along opposite sides of a cage 13. The cage 13 encloses a pair of parallel shafts 14 and 15 which lie adjacent each other. The central length of the shafts 14 and 15 are situated in the cage 13. In comparing the views of FIGS. 2 and 3, it can be seen that the cage 13 is provided with longitudinal V-shaped tracks 16 which are supported on sets of rollers 17 fixed on the frame structure 12 located along each side of the cage 13. There are usually two or more rollers 17 at each track to lend stability to the longitudinal movement of cage 13. As seen in FIGS. 3 and 4, the cage is formed with a pair of perforated grates 18 so that the grates 18 cooperate with the discharge of the material being shredded in the cage 13 by and between the cutting discs 19 and 20 on the respective shafts. The cutting disc 19 is received on the hexagonal shaped shaft 14 and cutting disc 20 is mounted on a similar hexagonal shaft 15. These discs 19 and 20 are arranged to overlap so material to be shredded is actually reduced by a scissor action. These cutting discs 19 and 20 occupy almost all of the interior area of the cage 13 except for dead spaces at the respective opposite end walls 13 A and 13 B of the cage 13.

Figure 8:
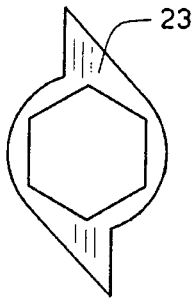
FIG. 8 is a face view of a shaft driven waste material stirring disc.
Figure 7:
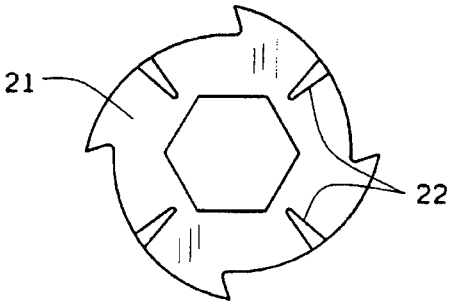
FIG. 7 is a face view of a shaft end cutter disc.

Before discussing an important function of the apparatus, there is shown in FIG. 7 an end cutting disc 21 on shaft 15. That disc 21 has peripheral cutting teeth like the other teeth of discs 20, and in addition there are notches 22 in the surface of the disc 21 facing the cage end wall 13A, as in FIG. 4. A similar disc 21 is also located on the shaft 15 facing the cage end wall 13B. The positions of the respective discs 21 facing the cage end walls 13A and 13B forms a space having a thickness about equal to the thickness of discs 20. That space is referred to as a "dead" space because there is no toothed disc to move into and occupy that space. It has been found ;that in shredding mills of the general construction in the prior art material can work its way into the "dead" space and not be subject to shredding reduction. This defect is especially true when vehicle tires are fed into the shredding cage 13. Likewise material can work its way into the "dead" spaces at each end of the shaft 14 in the cage 13. The solution to shredding material in the "dead" spaces at the opposite ends of the disc assembly on shaft 14 is by mounting a lifting tooth element 23 (see FIG. 8) on each end of shaft 14 to rotate with shaft 14 to sweep elements 23 through the "dead" space and dislodge material that may need further shredding reduction.

The functions performed by the discs 21 on shaft 15 and the lifting tooth element 23 of shaft 14 are associated with the oscillatory movement of the cage 13, and especially due to the grate formation 18 which move back and forth under the shredding discs on shafts 14 and 15. That cage 13 movement causes the cage end walls 13A and 13B to alternately squeeze material that works its way into the before mentioned "dead" spaces. The squeeze applied to vehicle tire material imposes an extra load on the driving motors for the shafts 14 and 15. That extra load on the shafts 14 and 15 is overcome by the shredding action imposed on the material in the dead space by the slots 22 in the face surfaces of discs 21, and by the lifting removal of material through the action of the tooth elements 23 carded on shaft 14.

The motor drive for the shafts 14 and 15 is through a bearing assembly 25 on the opposite ends of the respective shafts 14 and 15. Each bearing assembly 25 has its individual power input unit 26 driven through a belt and pulley system 27 connected to an electric motor 28. This drive arrangement is seen in FIGS. 1 and 2, although other drive arrangements can be incorporated to deliver the power to the shafts 14 and 15.

Figure 5:
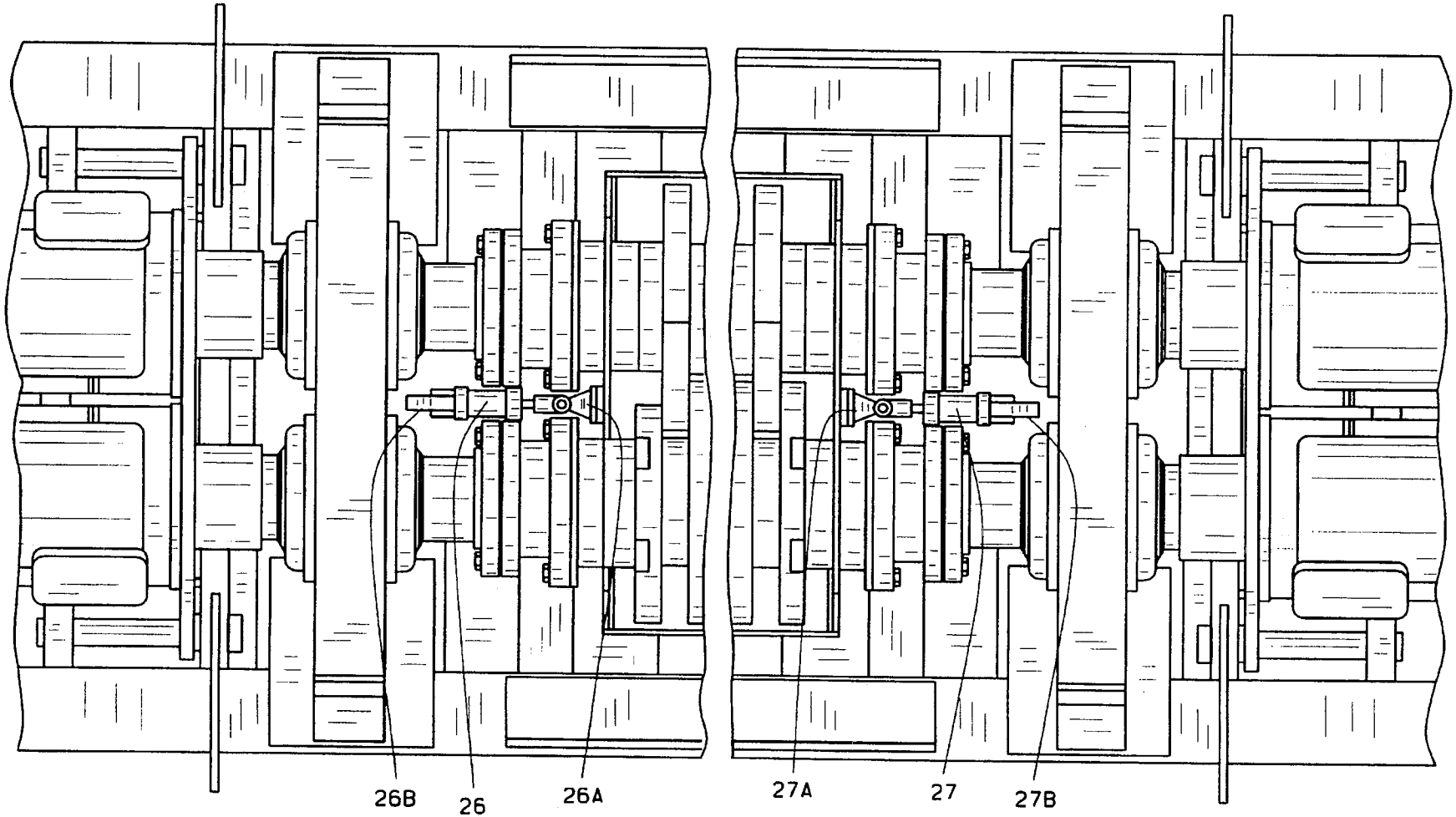
FIG. 5 is a fragmentary and foreshortened plan view of the hydraulic drive means for oscillating the cage for the rotary ripshear shafts.
Figure 6:
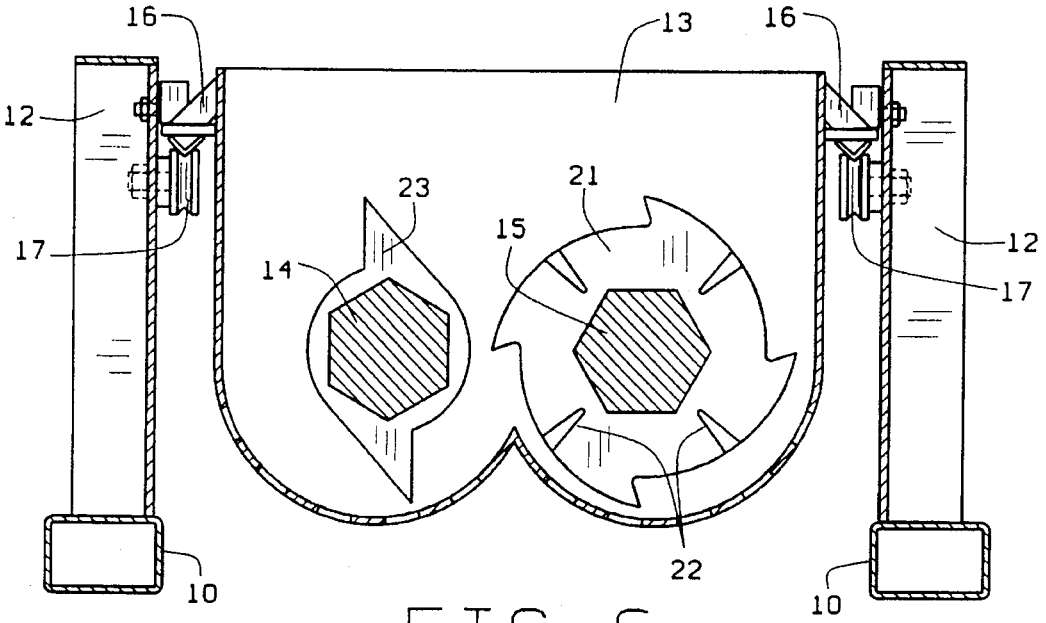
FIG. 6 is an end sectional view of the shredding shafts taken along line 6—6 in FIG. 2.

FIG. 5 illustrates an oscillating actuator system for drying the cage 13 relative to the stationary shafts 14 and 15. Since the cage 13 must be able to oscillate horizontally along the shafts, it must also have some freedom to adapt its position to the way the material in the cage is buffeted about by the sheafing discs 19 and 20. That buffeting is likely to tend to cause the cage 13 to swing laterally on the supporting tracks 17. Accordingly, the oscillating drive for the cage 13 seen in FIG. 5 comprises a pair of hydraulic cylinders 26 and 27 which are energized in a tandem control so that as one cylinder moves in a first direction, either fight or left, the other cylinder moves in It second direction that is complimentary to the motion by the first cylinder to promote uniformity of longitudinal movement of the cage 13. As depicted in FIG. 5, the cylinder 26 is connected to the end wall 13A of the cage 13 by a joint 26A which has movement about a vertical axis. The cylinder 26 is also connected to the stationary base 10 at a joint 26B for limited movement about a horizontal axis. The opposite end of the cage 13 has a cylinder 27 connected to the cage end wall 13B at a joint 27A with movement about a vertical axis, and a second joint 27B connects the cylinder 27 to the base 10 for movement about a horizontal axis. The result of the motion imparted to the cage 13 is compounded by its ability to accommodate both linear oscillation and angular displacement.

Figure 9:
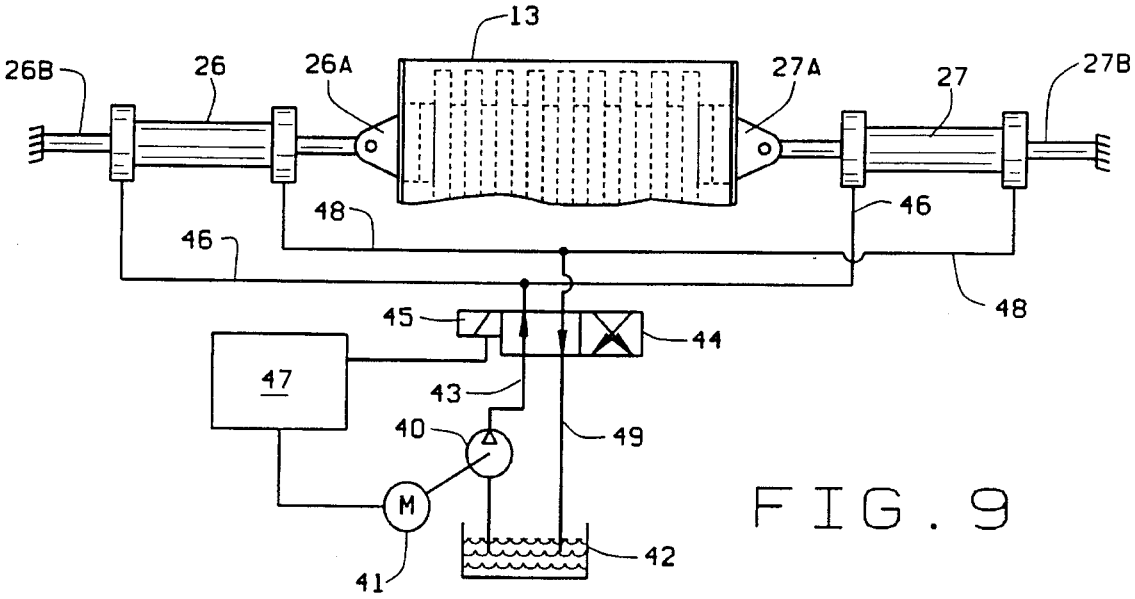
FIG. 9 is a schematic design of a cage control system.

The control system for oscillating the cage 13 is disclosed schematically in FIG. 9. The mans for effecting the oscillatory motion is composed of hydraulic cylinders 26 and 27 connected to a pump 40 driven by an electric motor 41 to draw hydraulic fluid from a suitable reservoir 42. The pump delivers the fluid by conduit 43 to a flow directed valve 44 positioned by a spring 45 (not shown) to seek a position to direct the fluid into conduit 46 so the pressure fluid forces pistons 26 and 27 to move in the same direction (left to right) so the cage 13 is moved in response. The control 47 is set to alternate hydraulic fluid flow at valve 44 so it returns fluid from conduits 48 and 49. Next, fluid is delivered from valve 44 to conduit 48 while returning fluid by conduits 46 and 49 to the reservoir 42 which effects reversal of the direction of the thrust of cylinders 26 and 27 to reverse the direction of travel of the cage 13 (right to left). As long as the shredder is operative to shred waste material, the cage 13 is oscillated by the control means illustrated in FIG. 9. The result of the cage oscillatory movement is that the grate 18 in the cage 13 sweeps across the shafts 14 and 15 to expose the shredder material to the grate apertures, thus preventing the material from accumulating in the grate.

The effect of the allowable movement of the cage 13 relative to the fixed position and rotary motion of the shafts 14 and 15 is that when material works its way into the dead spaces at the respective ends of the cage 13, the oscillation and angular movement of the cage 13 causes the end walls 13A and 13B to apply a squeezing compression on such material. That squeeze applies a load on the shaft drives, but that load is reduced in two ways; first the discs 21 on the shaft 15 cause the cutting slots 22 to shred the material for alleviating that load quickly, and the elements 23 quickly kick or lift the material out of the dead spaces to further alleviate the load.

In the view of the several drawings it is ascertained that the shredding apparatus which as a pair of side-by-side material reducing shafts having cooperating shredding discs thereon arranged in an open top cage having cage end walls through which the shafts extend for cooperating with power operated driving means, and shredder sizing material grate to receive the shredder material from the shafts. The pair of shafts undergo material reduction while in stationary positions in the cage but are subject to oscillatory movement of the cage which results in dead spaces in the cage between the shredding discs and the cage end walls where waste material can work into those dead spaces and alternately be squeezed by the cage end walls which increases the load on the shaft drive. However, the load on the shaft drive is alleviated by the provision of devices on the shafts at the end walls of the cage to not only displace waste material working its way into the dead spaces, but can be cut down in its thickness to further alleviate the squeezing reaction that otherwise exerts a shaft driving load increase.

In addition to the foregoing provisions, the apparatus has hydraulic means in the cage to alternate movement of the cage in opposite directions to cause the grate to sweep back and forth relative to the stationary shredding shafts to assist in sizing the reduction of the waste material. Thus the alternating movement of the grate and cage, and the squeezing of the material at the ends of the shredding shafts are two unique functions that obtain a refinement in the shredding result of waste material without jamming the material in the cage to overload the shaft drive.

A further unique feature of the shredding apparatus is the suspension of the cage in a frame on track and roller supports which make the cage easy to oscillate during shredding of waste material, and especially in view of the fact that vehicle tires are difficult to shred and can easily jam shredders but for the provision of devices to reduce the development of tire waste material working into dead spaces in the cage, for the shredding shafts.

The foregoing disclosure has unique importance not before known to those having skill in the relevant art.

What is claimed is:

1. Rotary shredding apparatus for the conversion of waste material into a shredded size adaptable for reuse in the manufacture of useful products, the shredding apparatus comprising:

a) a frame having spaced apart wall structure to define a space therebetween;

b) a material shredding cage disposed in the space between said wall structure; said cage having an open top and opposite side and end walls;

c) a pair of shafts in side-by-side parallel relation operably mounted in said apparatus to extend through said opposite end walls of said cage;

d) a series of shredding discs on said parallel shafts in positions for shredding waste material introduced to said cage open top upon said pair of shafts in said cage;

e) shredded material sizing grate surfaces positioned beneath said pair of shafts to be carried by said end walls and said side walls in position to release the shredded material from said cage; and f) an oscillating actuator connected to said opposite end walls of said cage for imparting an oscillatory movement to said side and end walls of said cage relative to said pair of shafts for distributing the waste material over said pair of shafts for reduction of such waste sufficient to pass through said grate.

2. The shredding apparatus set forth in claim 1 wherein said opposite end walls of said cage are movable in response to the oscillatory movement of said cage toward and away from said shredding discs to leave dead spaces alternately between said opposite walls and said shredding discs; and material handling devices movable in said dead spaces on said shafts being alternately operable in said dead spaces for engaging material distributed by said rotary shafts into said dead spaces.

3. The shredding apparatus set forth in claim 2 wherein said material handling devices include discs on one shaft for shearing waste material distributed into said dead spaces against said cage end walls.

4. The shredding apparatus set forth in claim 2 wherein said material handling devices include material lifting elements on the second shaft of said pair of shafts in position to dislodge waste material distributed into said dead spaces against said cage end walls.

5. Rotary shredding apparatus for reduction of waste material, the apparatus comprising:

a) a waste material receiving cage having walls open at its top and having grate surfaces opposite said open top carried by said walls;

b) a pair of rotary shredding material shafts operably mounted to extend through said cage walls and having ends exposed exterior to said cage walls;

c) material shredding discs arranged on said shafts and extending into positions in side of and adjacent said cage walls;

d) power driving means connected to said shafts for driving said rotary shafts in fixed shredding positions in said cage;

e) power oscillating means connected to said cage for moving said cage relative to said shafts so that said material shredding discs squeeze waste material against said cage walls to impose loads on said power driving means; and f) rotary driving power load reducing devices on said shafts to rotate relative to said walls for reducing the load imposed on said power driving means.

6. The rotary shredding apparatus set forth in claim 5 wherein said power load reducing devices on said shafts include waste material displacing devices on one of said pair of shafts and other power load reducing devices on the other one of said pair of shafts for shredding waste material to reduce the squeezing effect against said cage walls.

7. Rotary shredding apparatus for reducing waste material, the apparatus comprising:

a) a frame having spaced apart walls;

b) a material receiving cage disposed in said space between said frame walls;

c) track and roller cooperating supports for suspending said cage between said frame walls;

d) material shredding shafts extending through said cage to reduce waste material therein;

e) motor means exterior to said cage for driving said material shredding shafts in said cage;

f) shredded material sizing grates on said cage positioned under said shredding shafts; and g) cage oscillatory means connected to impart motion to said cage relative to said shredding shafts for distributing shredded waste material along said shredding shafts for discharge through said grate.

8. The rotary shredding apparatus set forth in claim 7 wherein said track and roller cooperating supports comprise tracks on said cage and rollers on said frame walls.

* * * * *